US007364455B2

(12) United States Patent
Diessner et al.

(10) Patent No.: US 7,364,455 B2
(45) Date of Patent: Apr. 29, 2008

(54) INTEGRATION AREA, SYSTEM AND METHOD FOR PROVIDING INTERCONNECTIONS AMONG COMPONENTS

(75) Inventors: Daniel J. Diessner, Mukilteo, WA (US); Bradley J. Mitchell, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/581,658

(22) Filed: Oct. 16, 2006

(65) Prior Publication Data

US 2007/0032125 A1 Feb. 8, 2007

Related U.S. Application Data

(62) Division of application No. 10/731,829, filed on Dec. 9, 2003, now Pat. No. 7,121,875.

(51) Int. Cl.
*H01R 12/24* (2006.01)

(52) U.S. Cl. ..... 439/498; 439/189; 439/44

(58) Field of Classification Search ..... 439/498, 439/540.1, 505, 189, 44
See application file for complete search history.

(56) References Cited

U.S. PATENT DOCUMENTS 4,143,931 A * 3/1979 Skare et al. ..... 439/67
6,231,354 B1 5/2001 Church et al.
6,554,639 B2 4/2003 Doriski, Jr.

FOREIGN PATENT DOCUMENTS

JP 56-13674 * 2/1981

* cited by examiner

*Primary Examiner*—Javaid H. Nasri
(74) *Attorney, Agent, or Firm*—Alston & Bird LLP

(57) ABSTRACT

The integration areas, system and method of interconnecting components provide efficient techniques for separating the conductive path between components from the pin-to-pin integration between components through the use of conductive elements that may be interconnected in a variety of manners. The interconnections between the conductive elements may be configured automatically and may be modified relatively easily. The integration area includes component connection receptacles, first conductive elements that extend from each component connection receptacle, second conductive elements that extend across at least one first conductive element, and connections between the conductive elements to interconnect the components. The conductive elements may include flatwire segments and/or printed circuit boards. The connections between the conductive elements may be made with pins and jumpers, connection vias and solder patches and/or various insulation barriers through which the conductive elements connect.

8 Claims, 13 Drawing Sheets

INTEGRATION AREA, SYSTEM AND METHOD FOR PROVIDING INTERCONNECTIONS AMONG COMPONENTS

CROSS-REFERENCE TO RELATED APPLICATION

The present application claims priority to and is a divisional of U.S. patent application Ser. No. 10/731,829 filed Dec. 9, 2003, now U.S. Pat. No. 7,121,875, the contents of which are incorporated herein in their entirety.

FIELD OF THE INVENTION

The invention relates to integration areas that provide interconnections among components and, in particular, integration areas that separate the conductive path between components from the integration connections between components.

BACKGROUND OF THE INVENTION

Connections among components typically perform two functions: (1) provide a conductive path between components and (2) provide pin-to-pin integration between connectors. The conductive paths are generally provided by conventional wire and cables that extend between components and/or other connection receptacles, while the pint-to-pin integration generally refers to the manner in which the individual wires or other conductive paths that extend from the respective components interconnect with one another.

Thus, if a system includes very many components to be interconnected, the wires and cables and their routing and interconnections quickly become complex and cumbersome. For example, in the aircraft industry, the same wire bundles may include pin-to-pin connections between line replaceable units (LRUs), such as wire 7 of bundle W123 and wire 5 of bundle W456, and connections between the LRUs and disconnect brackets, such as wire 6 of bundle W123 and wire 2 of bundle W456, as shown in FIG. 1. In addition, these bundles may also contain wires that provide connections between various remote portions of the aircraft and wires that provide connections between various local racks and/or shelves within the racks (not shown). Thus, if a change in the configuration of the connections between the LRUs, the LRUS and the disconnect brackets, the remote portions of the aircraft and/or the racks and/or shelves is desired, it is very complicated and time consuming to determine which wires must be manipulated.

Aircraft wiring is further complicated because many of the wire bundle assemblies are unique to a particular aircraft. Thus, there is a lot of variability in the wiring configuration among aircraft such that the wiring of each aircraft must be customized to the particular aircraft and cannot be automated. The wiring, therefore, is not only very complicated to modify, but also very complicated to initially design and install.

To address the problems created by the complicated wire bundles, integration areas have been developed. These integration areas provide for the desired pin-to-pin interconnections between the individual wires or other conductive paths that extend from the respective components, thereby simplifying the wiring or other conductive paths that extend from the components since it need not be rerouted to accomplish the desired pin-to-pin interconnection.

The conventional integration areas attempt to segregate the wire bundles by separation codes, such that only certain types of connections are included in each wire bundle. For example, connections between the LRUs would be included in one type of wire bundle(s), and connections between the LRUs and disconnect brackets may be included in another type of wire bundle(s). While the conventional integration areas provide assistance in determining the type of wire in each bundle, the conventional integration areas are still very complicated to design and install because all of the wiring continues to be unique to each aircraft and, therefore, must be customized to the particular aircraft.

Thus, there is a need in the aircraft and other industries for wiring integration areas that provide an efficient technique for separating the conductive path between components and the pin-to-pin interconnections that are required between components, but that does not require customized wiring design and installation. In addition, there is a need for integration areas that may be easily modified after installation.

BRIEF SUMMARY OF THE INVENTION

The present invention provides an integration area, a system of integration areas and a method for interconnecting a plurality of components. The techniques of the present invention efficiently separate the conductive path between components from the pin-to-pin interconnections that are required between components by creating an integration area where pin-to-pin integration takes place via connections within and between conductive elements. Because of the nature of the conductive elements, the connections between the conductive elements may be made automatically based upon a particular configuration for the integration area. In addition, the connections within the integration area may be easily changed, if needed.

The integration area includes component connection receptacles, first conductive elements that extend from each component connection receptacle, second conductive elements that extend across at least one first conductive element, and connections between the first and second conductive elements. The conductive elements include an insulative portion and multiple conductive portions. For example, in one embodiment, the conductive elements may include flatwire segments and/or printed circuit boards. In further embodiments, the component connection receptacles may be connector shells and inserts, and in these embodiments, each first conductive element may be connected to an insert at one end.

The connections between the conductive elements may be made using a variety of techniques. In one embodiment, the connections include pins between respective conductive elements and jumpers that connect at least two of the pins. In another embodiment, the connections between conductive elements include connection vias between respective conductive elements and solder patches that connect at least two of the connection vias.

In further embodiments, the connections include an insulation barrier between the conductive elements, and the insulation barrier defines at least one opening through which the conductive elements connect. In this embodiment, the opening(s) may be filled with a conductive material, such as solder or a conductive pin may extend through at least one of the openings to connect the conductive elements. Other types of connections between the conductive elements may include a fluid insulation material between the conductive elements that may be displaced at points of connection between the respective conductive elements, in some embodiments of the integration area. In other embodiments, the connections may include connection vias between the respective conductive elements that provide connections at all connection points between the conductive elements. Openings may then be defined at the points of connection where connections between the respective conductive elements are undesirable.

Other embodiments include openings defined in the first and second conductive elements, and the openings are at least partially plated with a conductive material. As such, the conductive material contacts at least one conductive portion of each of the first and second conductive elements such that connections between the first and second conductive elements may be made by at least one conductive pin that extends through respective openings in the first and second conductive elements. In this embodiment, an insulation barrier may be located between the first and second conductive elements to prevent the conductive material of the plated openings in one of the first and second conductive elements from contacting the conductive material of the plated openings in the other of the first and second conductive elements. Thus, the insulation barrier also defines at least one opening aligned with respective openings in the first and second conductive elements. Another embodiment includes an array of spring-loaded pins located between the first and second conductive elements. In this embodiment, the pins are in contact with at least one of the conductive portions of one of the first and second conductive elements. This embodiment also may include an insulation barrier between the array and the other of the first and second conductive elements, where the insulation barrier defines openings where a connection between the first and second conductive elements is desired by allowing a respective pin to extend through a respective opening in the insulation barrier.

The system of integration areas of the present invention includes at least two integration areas as described above, and first and second backplanes that each include at least third and fourth conductive elements. The system also includes connection elements between the first and second backplanes. In one embodiment of the present invention, the connection elements may include single wire, coaxial cables, twisted pair wires, and/or flatwire. The integration areas of various embodiments of the system may include any of the connections between the conductive elements and/or within a backplane as described above. In some embodiments, the conductive elements may include flatwire segments and/or printed circuit boards.

In the method of interconnecting a plurality of components within a set of components, first conductive elements are provided, second conductive elements are positioned across at least one first conductive element, and the first and second conductive elements are connected at multiple connection points. In further embodiments, at least third and fourth conductive elements may be connected within the backplane at a second plurality of connection points. The first conductive elements may extend between each component connection receptacle associated with components within a set of components and the backplane. The connections between the respective conductive elements may be made by overlapping conductive portions of the respective conductive elements.

In some embodiments of the method, a configuration of connections within and among the components may be received and the connections at multiple connection points of the conductive elements may be automatically made based upon the configuration. In further embodiments, the backplane associated with one set of components may be connected directly to the backplane associated with another set of components or each backplane associated with a set of components may be connected to a second backplane. If a second backplane is utilized, then at least third and fourth conductive elements within the second backplane may be connected at third connection points. Again, conductive portions of the respective conductive elements may be overlapped to connect the conductive elements.

To connect the conductive elements, pins may be provided between the respective conductive elements and at least two of the pins may be connected, in one embodiment. In another embodiment, connection vias may be provided between the respective conductive elements and at least two of the connection vias may be connected to connect the conductive elements. In further embodiments, to connect the conductive elements, an insulation barrier defining at least one opening may be provided between the respective conductive elements and the conductive elements may be connected through the openings, in one embodiment. In other embodiments, fluid insulation material may be provided between the respective conductive elements of another embodiment and the fluid insulation material may be displaced at the points of connection.

Thus, the integration areas, system of integration areas and method of interconnecting components of the present invention provide efficient techniques for separating the conductive path between components from the pin-to-pin integration between components through the use of conductive elements that may be interconnected in a variety of manners. The interconnections between the conductive elements provide integration areas that are much less complex and easier to modify than conventional wiring bundles and integration areas.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention provides integration areas, a system of integration areas and a method for interconnecting a plurality of components. The techniques of the present invention efficiently separate the conductive path between components from the pin-to-pin interconnections that are required within and between components by creating an integration area where pin-to-pin integration takes place via connections between conductive elements. Because of the nature of the conductive elements, the connections between the conductive elements may be made automatically based upon a particular configuration for the integration area. In addition, the connections within the integration area may be easily changed, if needed.

Figure 1:
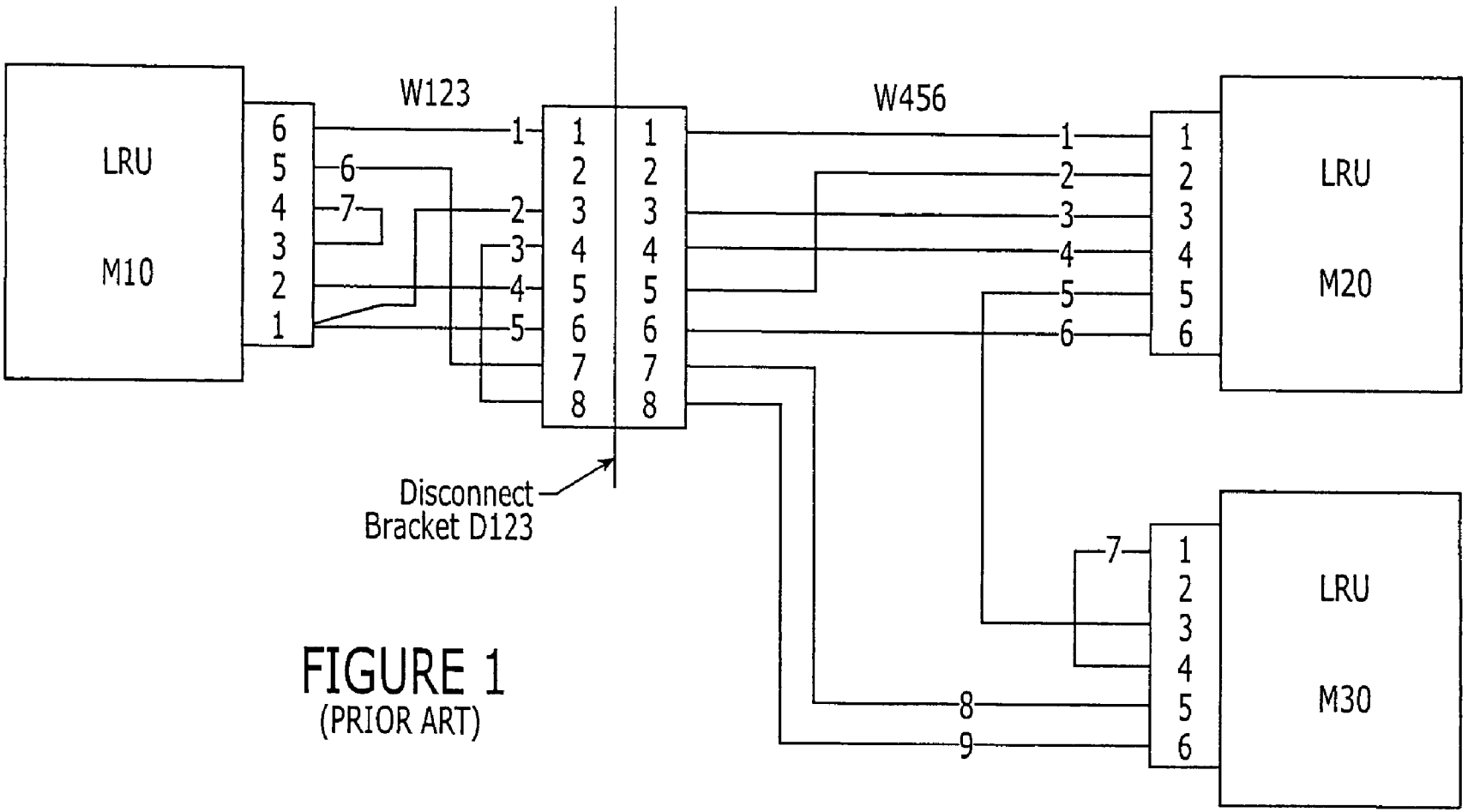
FIGURE 1 (PRIOR ART)
FIG. 1 is a schematic wiring diagram of conventional wire bundles that provide both the pin-to-pin interconnections between components and the conductive path between components.
Figure 2:
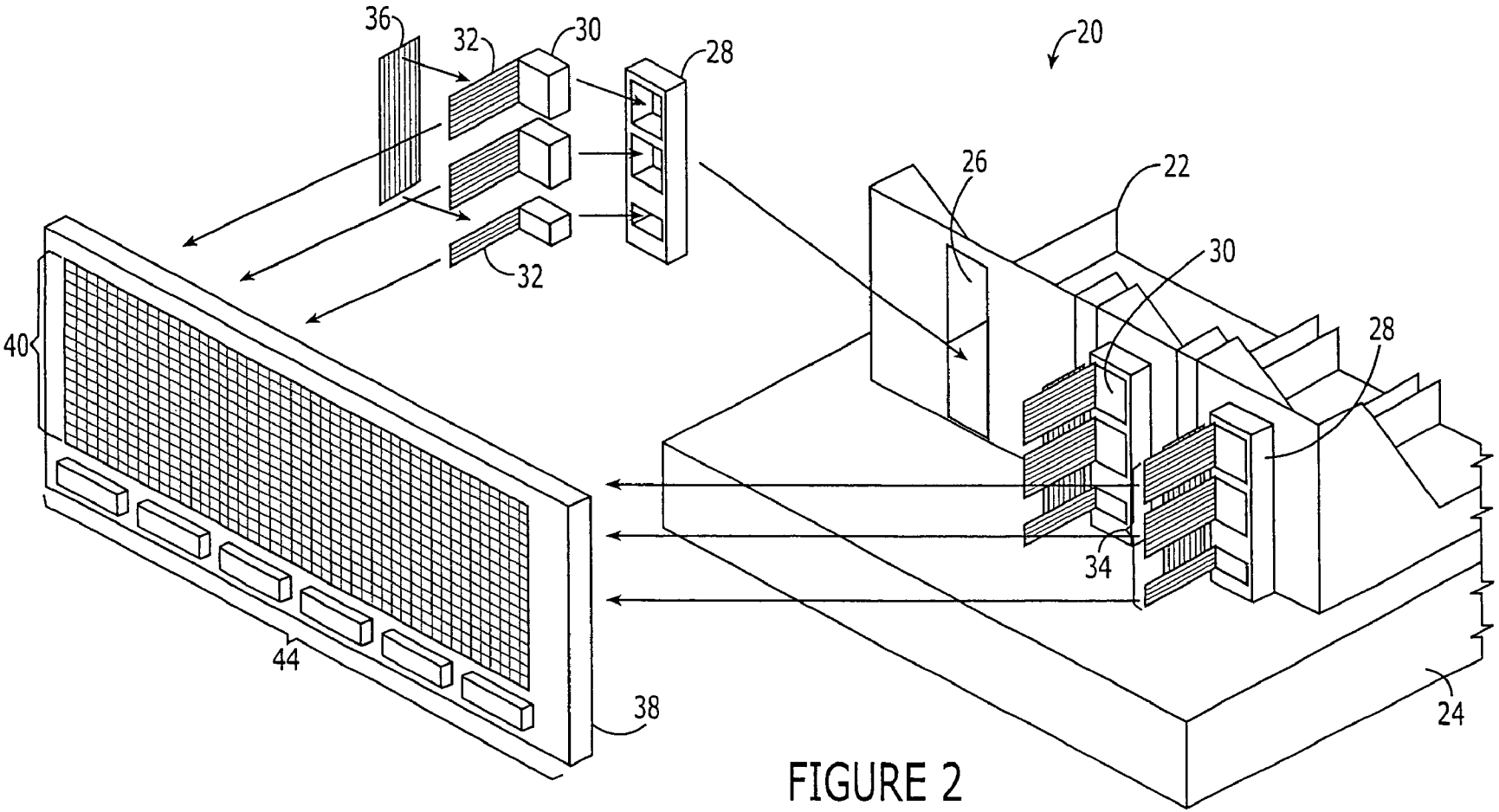
FIG. 2 illustrates a partially exploded view of integration areas that provide interconnections within and between connector inserts, according to one embodiment of the present invention.

FIG. 2 illustrates a partially exploded view of one embodiment of a system 20 of integration areas. In general, the integration areas may be utilized to interconnect a plurality of components. In the embodiment shown in FIG. 2, the components (not shown) may be positioned in trays 22. The components may be any type that require interconnections within or between the components, such as an equipment box or line replaceable unit used in the aircraft industry. The components include multiple pins extending from one side of the component that are typically arranged in various groupings depending upon the type of component. For example, many line replaceable units include three groupings of pins and each grouping may have a different number and/or arrangement of pins. The trays 22 are typically located on a shelf 24, but may stand-alone or may be located on any other type of support structure known to those skilled in the art. The trays 22 may define openings 26 in which connector shells 28 may be located. Connector shells 28 are, therefore, located within openings 26 and abut the side of the component from which the pins extend. The connector shells 28 also define openings that typically have a shape similar to the pin groupings of the component. As such, the pins may extend through the openings in the connector shell 28. Any type of connector shell known to those skilled in the art may be utilized. For example, in one embodiment, the connector shell may be an ARINC 600 connector shell, commercially available from Tri-Star Electronics International, Inc.

The openings in the connector shells 28 also may receive connector inserts 30. The connector inserts 30 receive the pins of the component on one side and connect to first conductive elements on the other side. The connector inserts 30 may be any type known to those skilled in the art, such as any of the family of ARINC 600 connector inserts, commercially available from Tri-Star Electronics International, Inc. The connector inserts 30, therefore, are conductively connected to the pins on the side of the insert facing the component and are conductively connected to one or more of the first conductive elements on another side of the insert. Thus, the connector inserts 30 provide the interface between the component and the conductive elements.

In one embodiment of the present invention, the first conductive elements 32 include an insulative portion and a plurality of conductive portions, such as flatwire, i.e. flex circuit, segments. As such, the connector inserts 30 may be conductively connected to one or more flatwire segment. The connections between connector inserts 30 and such conductive elements are the subject of U.S. patent application Ser. No. 10/757,838, entitled "Electrical Connector Insert and Apparatus and Associated Fabrication Method", which is incorporated herein in its entirety by reference.

To make interconnections with a component, an integration area 34 may be utilized to interconnect the pins of the component. In the embodiment illustrated in FIG. 2, integration area 34 includes first conductive element(s) 32 extending from at least one connector insert 30 in a connector shell 28 and a second conductive element 36 extending across the first conductive element(s) 32. The second conductive element may be the same type as the first conductive elements. For example, the second conductive element may also include an insulative portion and multiple conductive portions. The conductive portions may also be called conductive traces herein. Typically, the conductive portions are substantially parallel strips carried by the insulative portion. Thus, when the second conductive element extends across the first conductive element(s), the conductive portions of one of the first and second conductive elements cross, typically in a substantially perpendicular manner, the conductive portions of the other of the first and second conductive elements. In one embodiment, the conductive elements may be flatwire, i.e., flex circuit, segments. In other embodiments, the conductive elements may be printed circuit boards or any other type of element with conductive portions carried by or separated by an insulative portion. Connections between the first and second conductive elements may be made in any manner known to those skilled in the art, but specific embodiments of the connections between the first and second conductive elements are discussed below.

As shown in the embodiment illustrated in FIG. 2, an end of the first conductive element 32 that is not connected to the connector insert 30 may be connected to a backplane 38. In the embodiment shown in FIG. 2, the backplane 38 includes an integration area 40 where connections between at least some of the components located on the same shelf 24 and/or tray 22 may be made. The backplane 38, therefore, may include at least third and fourth conductive elements, each having conductive portions carried by an insulative portion, as described above with respect to the first and second conductive elements 32, 36. Thus, as described above, the third and fourth conductive elements may also be flatwire, i.e. flex circuit, segments and/or printed circuit boards, in specific embodiments of the present invention. As such, the conductive portions of one of a third conductive element cross, typically in a substantially perpendicular manner, the conductive portions of an adjacent fourth conductive element. If the backplane includes additional conductive elements, then the orientation of the adjacent conductive portions may alternate to create substantially perpendicular conductive portions between each pair of adjacent conductive elements.

The first conductive elements 32 are connected to the backplane 38 in any manner known to those skilled in the art. For example, as shown in the embodiment illustrated in FIG. 3, the first conductive elements 32 may be connected to the backplane 38 via standard connectors 42, such as the FF12 series printed circuit board connectors, commercially available from DDK, Ltd. Thus, any type of connections between the components to which the first conductive elements 32 are connected may be made in the integration area 40 of the backplane 38. The embodiment of FIG. 3, therefore, illustrates an embodiment of the integration area 34 between the connector inserts and the backplane, the integration area 40 of the backplane, and how the first and second conductive elements 32, 36 are connected to the backplane 38.

Figure 3:
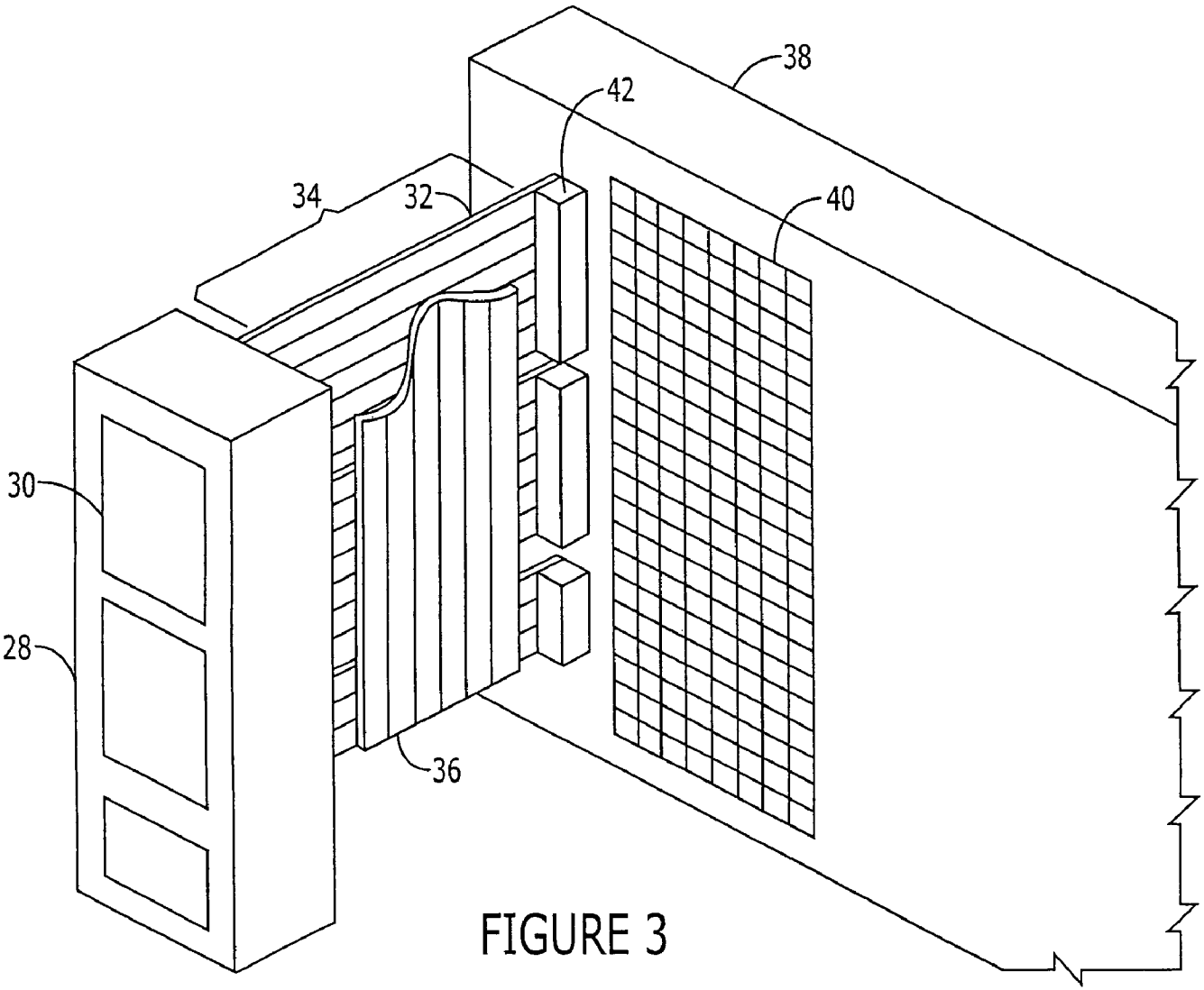
FIG. 3 is a perspective view of integration areas that provide interconnections within and between connector inserts, according to one embodiment of the present invention.

In the embodiments of the present invention illustrated in FIGS. 2 and 3, any signals transmitted by a component carried by the shelf 24 and/or trays 22 are transmitted through the backplane 38 to connectors 44, as shown in the embodiment of FIG. 2. Connectors 44 may be any type of connector known to those skilled in the art, such as connectors similar to EPX B rectangular multi-purpose connectors, commercially available from Radiall. Connectors 44 typically connect the backplane to a connection element that transmits signals from the backplane to another desired location. Any type of connection element may be utilized to carry the signals to the desired location. For example, the connection elements may be single wire, coaxial cables, twisted-pair wires, flatwire/flex circuit, and/or any other type of connection element.

Figure 4:
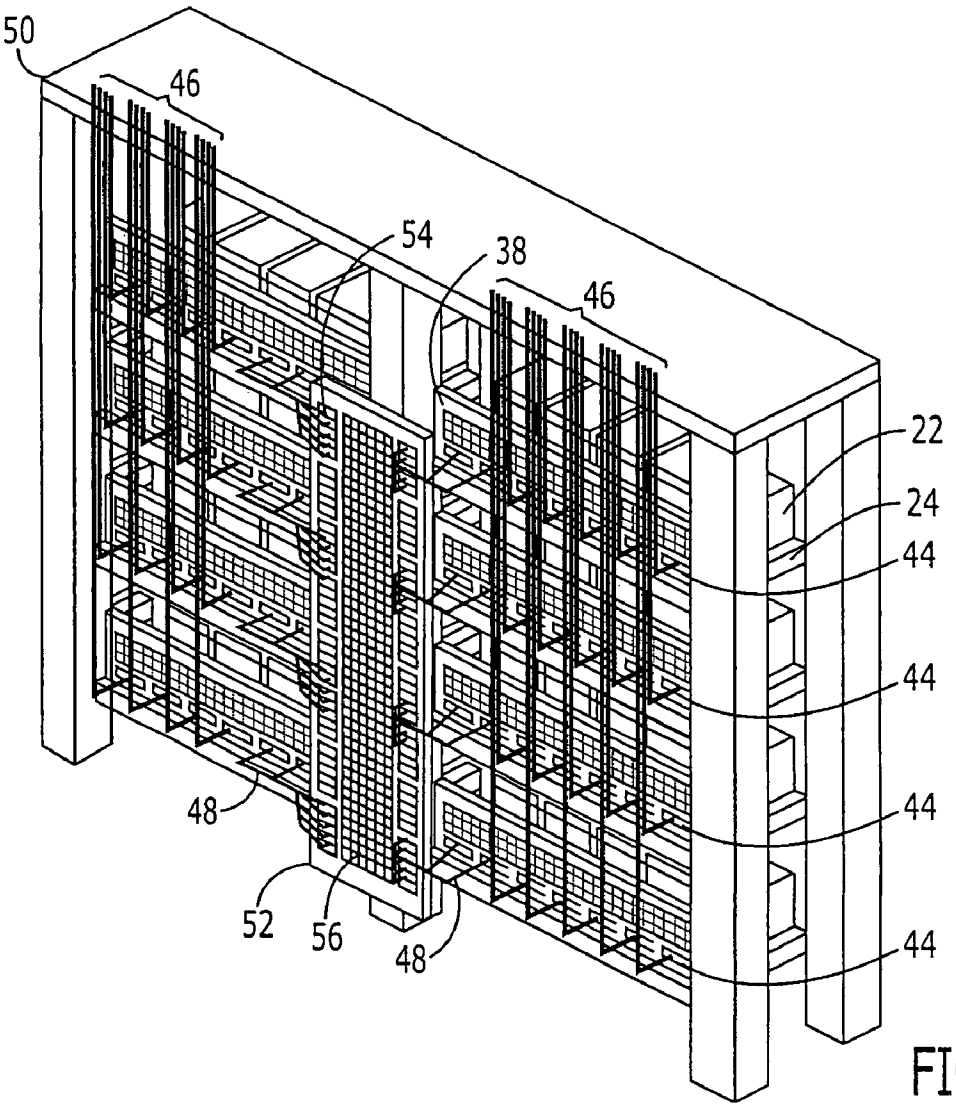
FIG. 4 is a perspective view of integration areas that provide interconnections among multiple components, according to one embodiment of the present invention.

FIG. 4 illustrates one embodiment of the connections between the backplane 38 associated with an equipment shelf 24 and/or trays 22 and other components via connectors 44 and connection elements 46, 48. In this embodiment, the equipment shelves 24 may be located in an equipment rack 50. Thus, in an aircraft embodiment, some of the connection elements 46 may transmit signals to another portion of the aircraft, such as another equipment shelf in another equipment rack by connecting directly to another backplane in another equipment rack and/or to any other area where the signals transmitted from the backplane 38 are desired. The embodiment of FIG. 4 also illustrates that others of the connection elements 48 may transmit signals from the backplane 38 to a second backplane 52. The second backplane 52, therefore may include connectors 54 to which the connection elements 48 connect to provide the desired signals to the appropriate sections of the second backplane 52.

In the same way that backplanes 38 have integration areas 40, so does the second backplane 52. Thus, the second backplane may have integration area 56 that may include the same elements as described with respect to backplane 38. As such, any type of connection between or among the components on various shelves 24 may be made in integration area 56 of second backplane 52.

Further integration areas may be located at any other area where further interconnections are desired. For example, multiple racks 50 may have an integration area that provides interconnections among components on different racks. In this embodiment, further connection elements may be connected between second backplane 56 and the multiple rack integration area and/or connection elements 46 may connect directly to the multiple rack integration area. Therefore, signals may be transmitted through each integration area or signals may bypass certain integration areas and connect directly to a desired subsequent integration area or directly to the desired component and/or end point.

In one embodiment, the integration areas 34 may be utilized to provide interconnections within and among only the connector inserts 30 associated with a connector shell 28, integration areas 40 may be utilized to provide interconnections among the components positioned in a certain tray 22 and/or shelf 24, and integration areas 56 may be utilized to provide interconnections among multiple trays 22 and/or shelves 24, such as in a rack 50. In other embodiments, however, the various integration areas may be utilized to provide any possible interconnections regardless of where the integration area is located and/or to which components the integration areas directly connect.

Although the integration areas described herein refer to equipment racks with shelves that require interconnections, other types of equipment storage facilities may also be interconnected utilizing the integration areas, system of integration areas and methods of providing interconnections of the present invention. For example, the integration areas described herein may also be utilized to provide interconnections among relay panels. Thus, the integration areas would connect to connectors in a relay panel and any interconnections within or between the connectors would occur in the integration area. As described above, further integration areas may be utilized to provide further interconnections for multiple relay panels and/or any other further connection areas.

As illustrated in FIGS. 2, 3 and 4, the integration areas, system of integration areas and method of providing interconnections of the present invention provide efficient interconnection areas where the pin-to-pin connections within and between components, shelves, racks, etc. may take place while the conductive path between the integration areas, embodied in connection elements, is separate from the interconnections. Thus, the conductive paths are organized and easy to identify, as illustrated in FIG. 4, and the integration areas, as described in detail below create interconnections that are also easy to configure and later identify and/or modify, unlike conventional wire bundles.

The integration areas 34, 40 and 56 may be created by connecting the conductive elements of the integration areas in any manner known to those skilled in the art. In particular, in embodiments of the integration area in which the conductive elements are embodied by printed circuit boards and/or flatwire/flex circuit, connections between the printed circuit boards and/or flatwire/flex circuit may be made in any manner known to those skilled in the art.

As described above, the conductive elements include an insulative portion that carries and separates conductive portions, i.e, conductive traces. The conductive portions are typically substantially parallel to one another, such that two adjacent conductive elements may be oriented such that the respective conductive portions cross one another, such as by being oriented substantially perpendicular to one another. Thus, as shown in FIGS. 5-14 and FIG. 16, one conductive element 58 may be oriented opposite another conductive element 60. In particular, the conductive traces 62 of conductive element 58 are oriented to cross, such as in a substantially perpendicular manner, the conductive traces 64 of conductive element 60. Because the conductive traces of at least one of the conductive elements are directly associated with and make electrical contact with particular items, such as pins, inserts, connectors, components, shelves, racks, panels, etc. depending upon the location of the particular integration area in which the conductive element (s) reside, the conductive traces cross the associated traces provide a conductive path for connecting the various items. For example, conductive traces 62 may be connected to particular pins of a component via a connection insert 30, as described above, and conductive traces 64 may provide a conductive path between the conductive traces 62 and, therefore, the pins once the desired conductive traces are connected.

Figure 5:
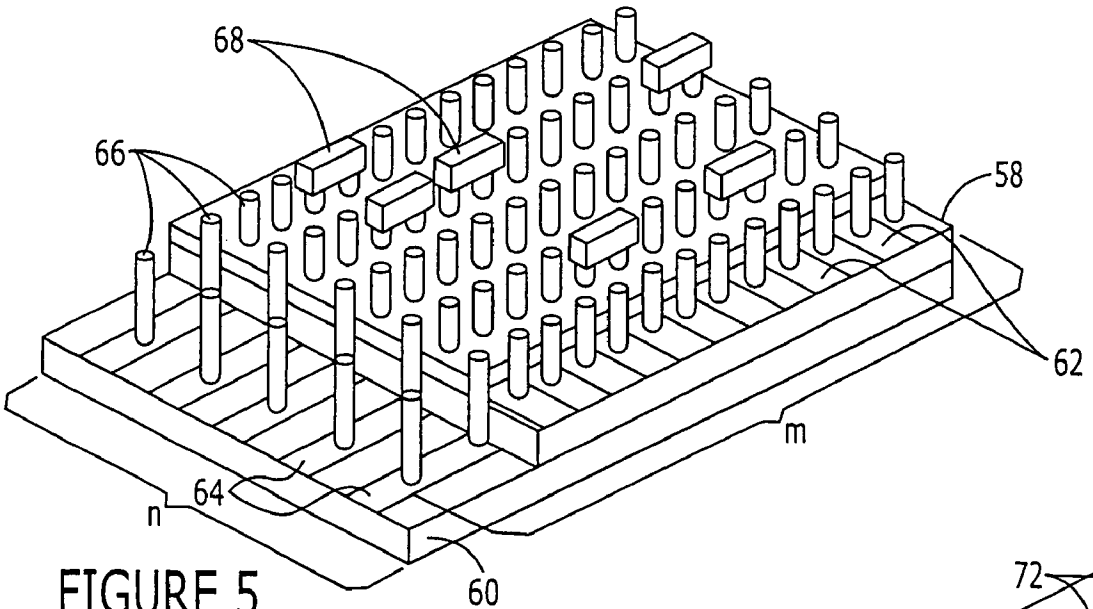
FIG. 5 is a perspective view of an integration area including pins and jumpers to make connections between the conductive elements, according to one embodiment of the present invention.

Examples of techniques for making connections between or among conductive traces are shown in FIGS. 5-13, but many other techniques for connecting conductive elements may exist and may be utilized for the connections. FIG. 5 illustrates one embodiment in which pins 66 provide a conductive path between conductive traces 62 and conductive traces 64. To provide the desired interconnections, the appropriate adjacent pins 66 are conductively connected via jumpers 68. This embodiment is typically used when the conductive elements 58, 60 include printed circuit boards, but may be used for other types of conductive elements also.

Figure 6:
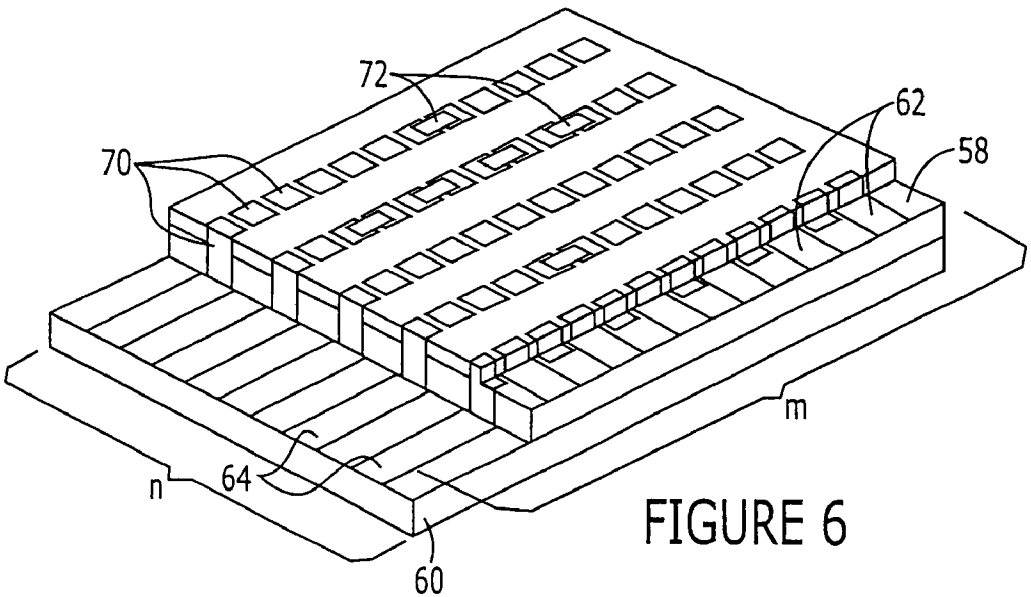
FIG. 6 is a perspective view of an integration area including connection vias and solder patches to make connections between the conductive elements, according to one embodiment of the present invention.

FIG. 6 illustrates another embodiment for connecting conductive elements 58, 60, which includes connection vias 70 to provide a conductive path between conductive traces 62 and conductive traces 64. To provide the desired interconnections, the appropriate adjacent connection vias 70 are conductively connected via solder patches 72. This embodiment is also typically used when the conductive elements 58, 60 include printed circuit boards, but may be used for other types of conductive elements also.

Figure 7A:
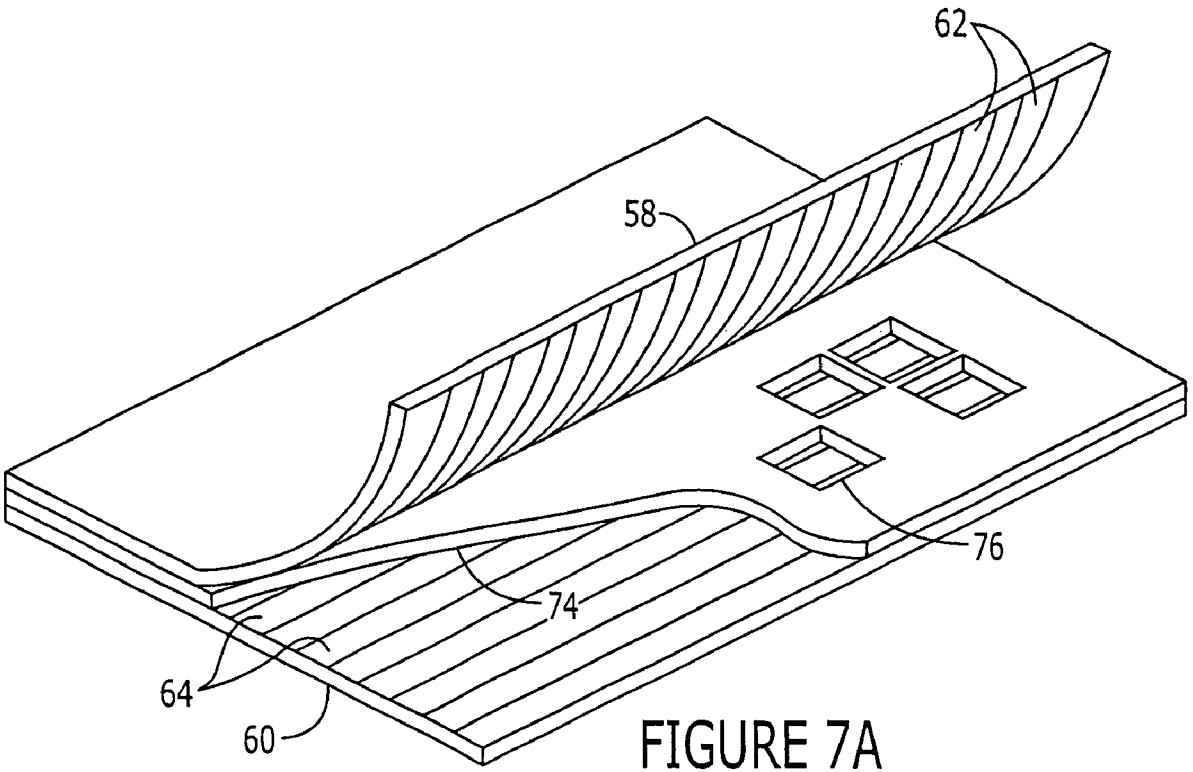
FIGS. 7A and 7B are a perspective view and a side view, respectively, of an integration area including an insulation barrier defining openings through which the conductive elements connect, according to one embodiment of the present invention.
Figure 7B:
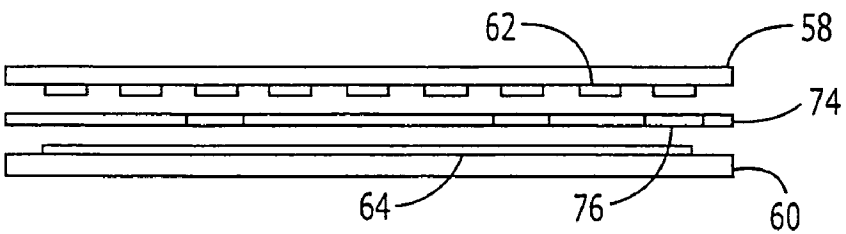

An insulation barrier 74 is utilized in the embodiment of FIGS. 7A and 7B to separate conductive traces 62 from conductive traces 64. The insulation barrier 74 may be made of any insulative material known to those skilled in the art, such as Tefzel® ETFE, commercially available from E. I. Du Pont De Nemours and Company Corporation. To interconnect the conductive elements 58, 60, openings 76 are defined in the insulation barrier 74 at the desired connection locations, such that a conductive trace 62 of conductive element 58 may connect to a conductive trace 64 of conductive element 60 through an opening 76. One technique for connecting the conductive traces through an opening 76 includes the local application of pressure and heat to the conductive elements 58, 60 at the opening 76 location to connect the desired conductive traces, such as by soldering the desired traces. Another technique may include applying heat and pressure across a larger portion or the entirety of the conductive elements, with interconnections resulting only where openings are defined in the insulation barrier as long as the insulation barrier properties are such that the insulation barrier can withstand the heat and pressure and prevent connections from being made where openings in the insulation barrier do not exist. Any other technique known to those skilled in the art for connecting the conductive traces through an opening 76 may also be utilized.

Figure 8A:
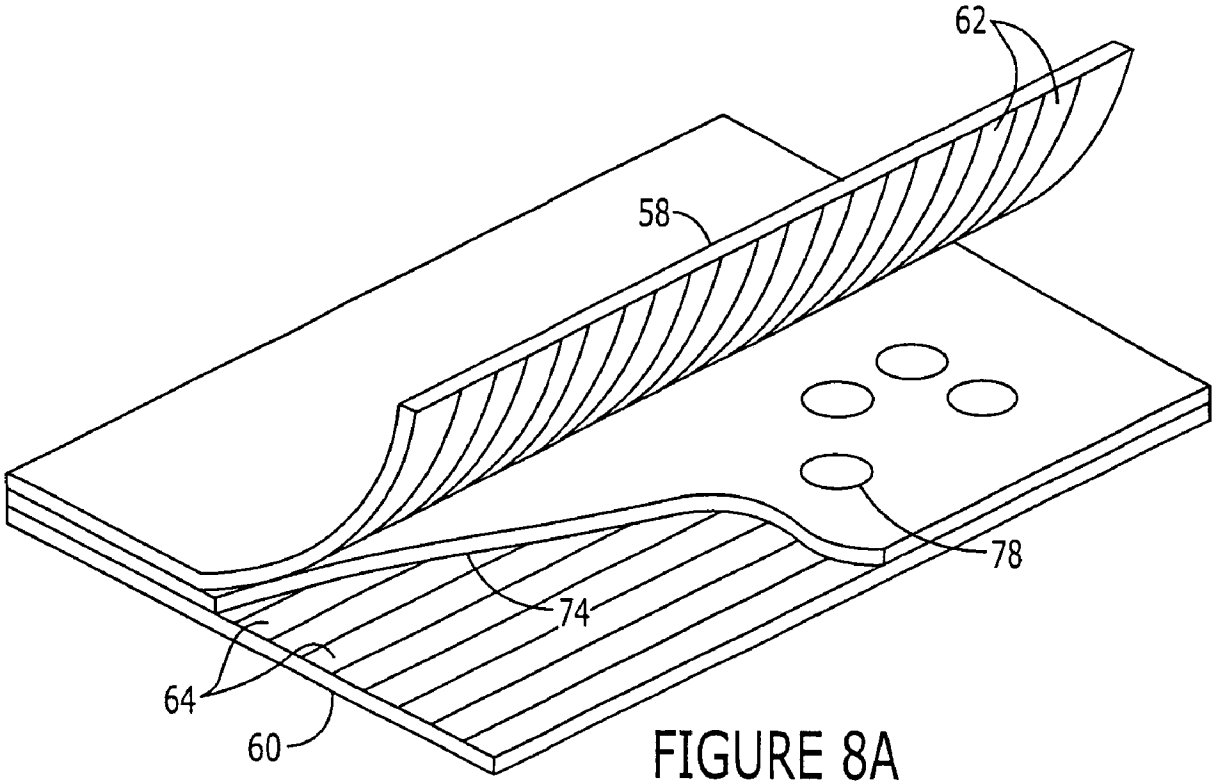
FIGS. 8A and 8B are a perspective view and a side view, respectively, of an integration area including an insulation barrier defining openings filled with a conductive material through which the conductive elements connect, according to one embodiment of the present invention.
Figure 8B:
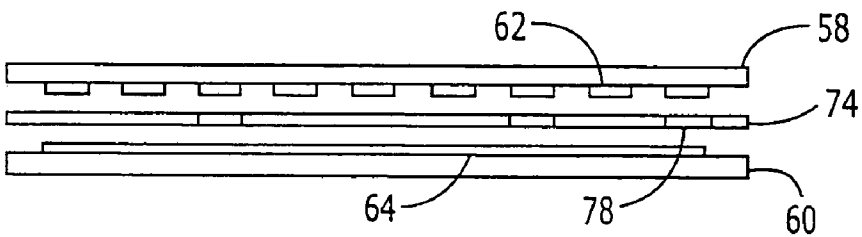

The embodiment of FIGS. 8A and 8B also illustrate the insulation barrier 74 between conductive traces 62 and conductive traces 64 in the same way as described with respect to FIGS. 7A and 7B. The insulation barrier 74 shown in FIGS. 8A and 8B, however, includes openings that are filled with a conductive material 78 at the locations where connections between conductive traces 62 and conductive traces 64 are desired. Any type of conductive material may be utilized in the openings, such as solder. In one embodiment, buttons of conductive material may be used to fill one or more of the openings, where the buttons may include conductive parts that are shaped to cooperatively snap together through an opening in the insulation barrier. If the conductive buttons or other conductive material that fills the openings contacts the conductive traces, then an interconnection exists, but in other embodiments, the conductive traces must be manipulated to ensure the conductive traces interconnect via the conductive material in the openings. One technique for connecting the conductive traces via the openings filled with conductive material 78 includes the application of pressure and heat to the conductive elements 58, 60 to connect the conductive traces at the desired locations, such as by soldering the desired traces to the conductive material. The heat and pressure may be applied locally at the location of the conductive material 78 or the heat and pressure may be applied over a larger section of the conductive elements 58, 60 because the insulation barrier 74 prevents the conductive traces 62, 64 from connecting at any point other than where the openings filled with conductive material are located. Any other technique known to those skilled in the art for connecting the conductive traces through an opening filled with conductive material 78 may also be utilized.

Figure 9:
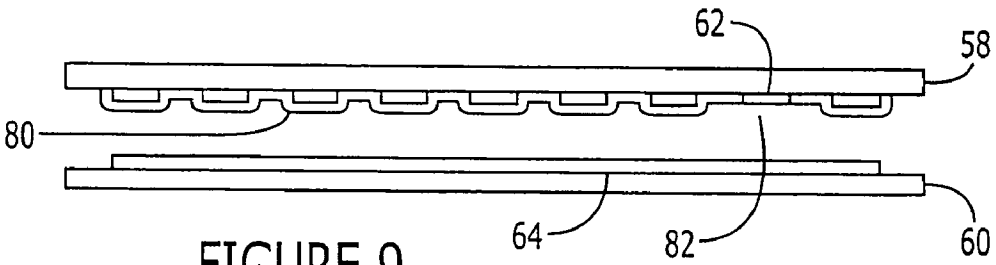
FIG. 9 is a side view of an integration area including an insulative coating on one of the conductive elements that is locally removed where the conductive elements connect, according to one embodiment of the present invention.

Another embodiment for connecting the conductive traces 62 to conductive traces 64 at only the desired locations includes applying an insulative coating 80 over one of the conductive traces 62 or conductive traces 64, as shown in FIG. 9. The insulative coating 80 then may be removed at locations 82 where connections between the conductive traces 62, 64 are desired. Similar to the embodiment in which openings are defined in an insulation barrier as shown in FIGS. 7A and 7B, the conductive traces 62, 64 of the embodiment of FIG. 9 may be connected at the locations 82 where the insulative coating 80 is removed by the local application of pressure and heat to the conductive elements 58, 60 at locations 82 to connect the desired conductive traces, such as by soldering the desired traces. Any other technique known to those skilled in the art for connecting the conductive traces at locations 82 may also be utilized.

Figure 10B:
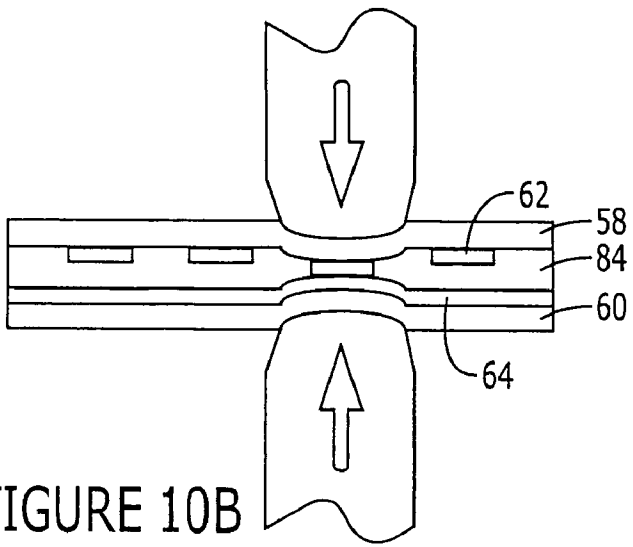
FIGS. 10A and 10B are a side views of an integration area including a fluid insulation material between the conductive elements that may be displaced where the conductive elements connect, according to one embodiment of the present invention.
Figure 10A:
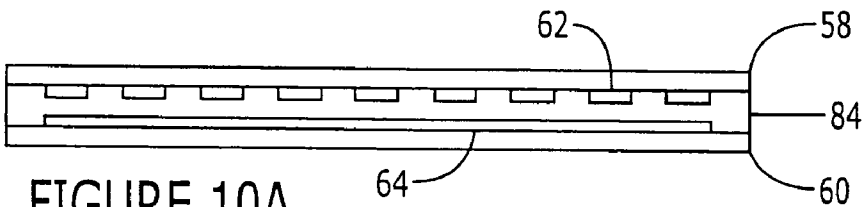

In further embodiments, the insulation barrier between conductive elements 58 and 60 is made of a fluid insulation material 84, such as a non-conductive gel, compressible foam, powder, etc. For example, an ultraviolet-cured or thermal-cured epoxy, such as that commercially available from Electronic Material, Inc. may be used for the fluid insulation material 84. Examples of this embodiment are shown in FIGS. 10A and 10B. One technique for connecting the conductive traces includes the local application of pressure and heat to the conductive elements 58, 60 at a desired location to connect the desired conductive traces, such as by soldering the desired traces, as shown in FIG. 10B. When applying the local pressure and heat, the fluid insulation material 84 is displaced at that location and, thus, the desired conductive traces connect. Alternatively or in addition to the displacement of the fluid insulation material 84, the heat and pressure may compress and/or burn the fluid insulation material away at the point of connection. In some embodiments, once the desired interconnections between the conductive traces have been made, the fluid insulation material may be cured, such as by the application of heat or ultraviolet light or in any other manner known to those skilled in the art. Any other technique known to those skilled in the art for connecting the conductive traces through fluid insulation material 84 may also be utilized.

Figure 11:
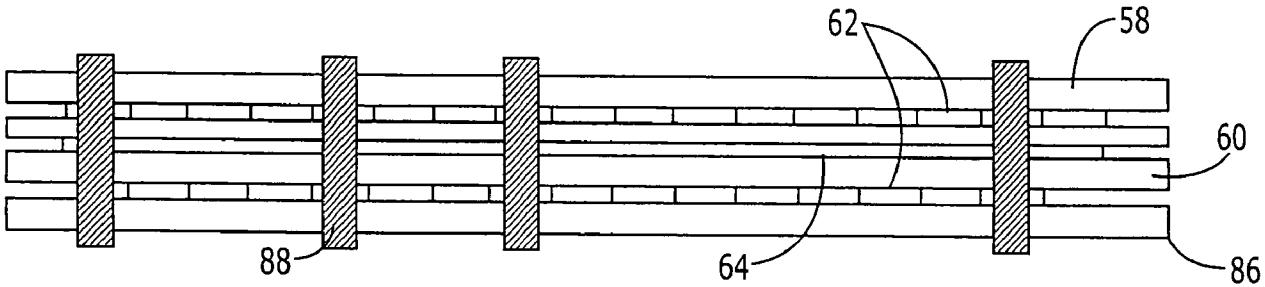
FIG. 11 is a side view of an integration area including three conductive elements through which conductive pins extend to connect the appropriate conductive elements, according to one embodiment of the present invention.

FIG. 11 illustrates an embodiment in which more than two conductive elements are utilized in an integration area. For example, in addition to conductive elements 58 and 60 as described herein, conductive element 86 is also added. Thus, conductive elements 58 and 86 have conductive traces 62 that are substantially perpendicular to the conductive traces 64 of conductive element 60. Also, as shown in the embodiment of FIG. 11, conductive elements 58 and 86 may be positioned such that conductive traces 62 do not align with one another, such that connections can be made between a conductive trace 62 of conductive element 58 and a conductive trace 64 of conductive element 60 without also connecting a conductive trace 62 of conductive element 86 and vice versa. While most of the integration area embodiments and techniques for interconnections in the integration areas described herein include only two conductive elements, the various embodiments described herein or that are known to those skilled in the art may include more than two conductive elements. In the embodiment of FIG. 11, conductive pins 88 are utilized to provide a conduct path between a desired conductive trace 62 and a desired conductive trace 64. The conductive pins may be made of any type of conductive material known to those skilled in the art, such as gold plated beryllium copper.

One technique for inserting the pins through the conductive elements includes defining aligned openings in the conductive elements at the locations where connections between the conductive traces 62, 64 are desired. The openings may have a slightly smaller cross-section than the conductive pins 88. The conductive pins 88 then may be driven into the conductive elements 58, 60 and 86 via ultrasound driving techniques, as known to those skilled in the art. Alternatively, when the conductive elements are made of a material that melts under the application of heat from an ultrasonic source, such as mylar®, commercially available from E. I. Du Pont De Nemours and Company Corporation, the conductive pins 88 may be driven through the conductive elements 58, 60 and 86 using ultrasonic heat that melts the material of the conductive elements to allow the conductive pins 88 to be inserted in the conductive elements at the desired locations. Any other technique known to those skilled in the art for connecting the conductive traces with conductive pins 88 may also be utilized.

Figure 12B:
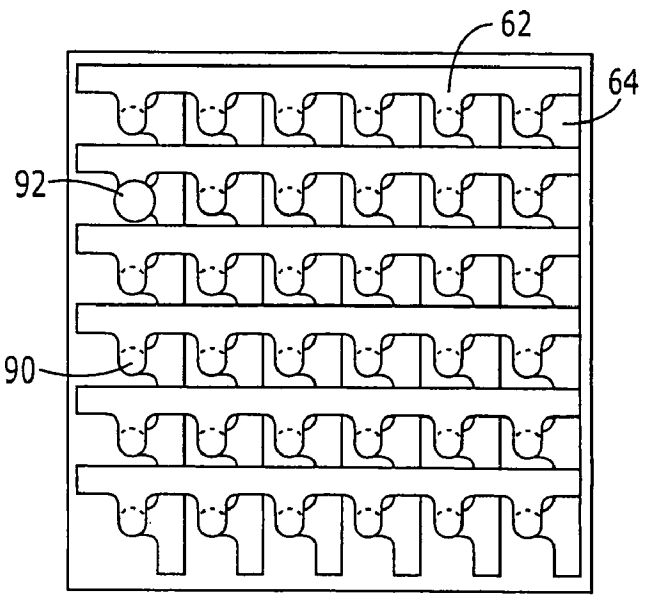
FIGS. 12A and 12B are a perspective view and a partial top view, respectively, of an integration area including connection vias providing interconnections at all connection points between the conductive elements with openings defined in both conductive elements where connections are undesired, according to one embodiment of the present invention.
Figure 12A:
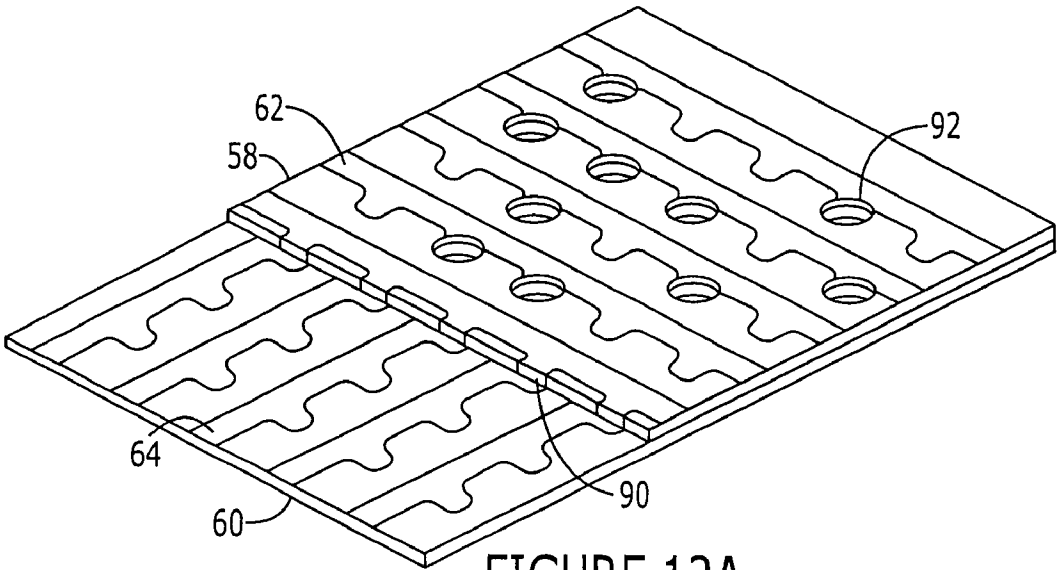

In a further embodiment for providing interconnections between the conductive traces 62, 64 of conductive elements 58, 60, respectively, each conductive trace 62 may intersect with each conductive trace 64 through the use of connection vias 90 at each point of connection between the conductive traces 62, 64, as shown in FIGS. 12A and 12B. FIG. 12B illustrates a top view of the intersections of the conductive traces 62 and 64 by removing the insulative material of conductive element 58 for clarity. In this embodiment, openings 92 may be defined through one or both of the conductive elements 58, 60 at locations where connections between the conductive traces 62, 64 are undesirable. Thus, the connection via 90 may be removed, such as by defining an opening 92 or by any other manner known to those skilled in the art, to eliminate undesired interconnections between the conductive traces 62, 64.

Figure 13A:
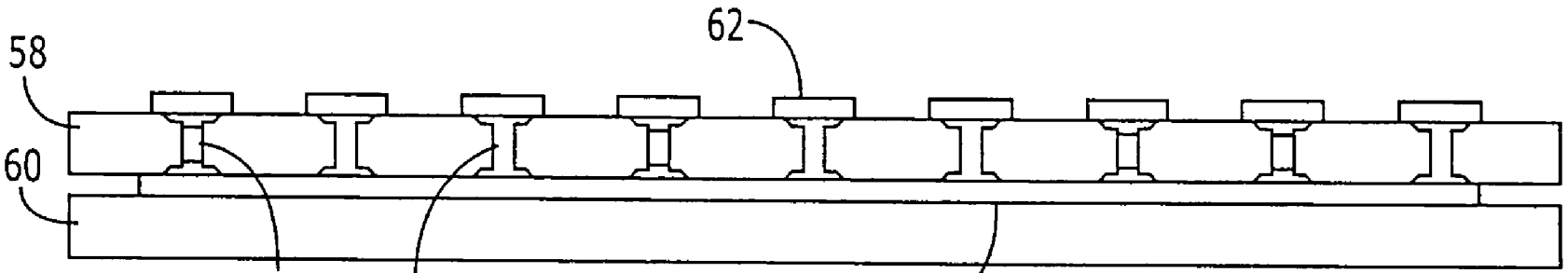
FIGS. 13A and 13B are side views of integration areas including cavities containing conductive material at all connection points between the conductive elements that may be closed to provide connections between the conductive elements, according to one embodiment of the present invention.
Figure 13B:
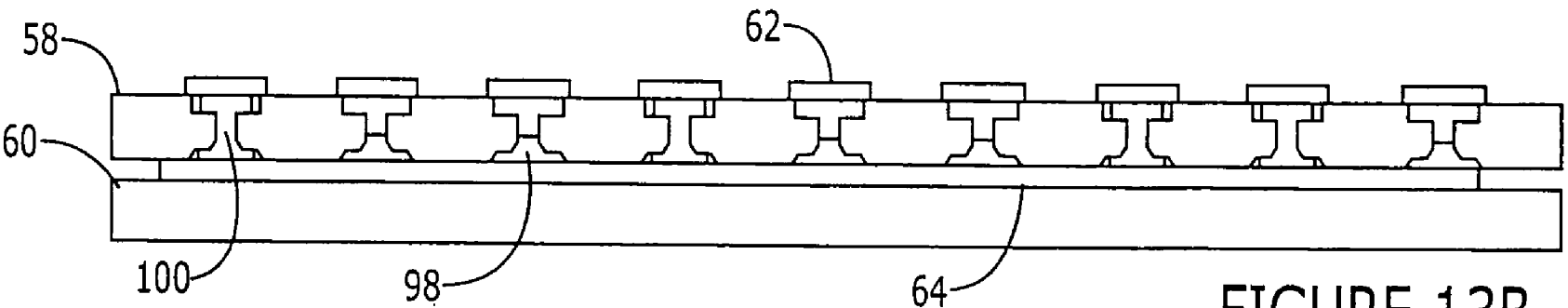

The embodiments of FIGS. 13A and 13B illustrate techniques for connecting the conductive traces 62 and 64 with conductive material, such as solder or any other conductive material known to those skilled in the art, that extends between the conductive traces 62 and 64 at the desired locations. For example, in the embodiment of FIG. 13A, solder fuse interconnections 94 are located at all possible connection points between the conductive traces 62 and 64. The cavities in which the solder fuse interconnections 94 are provided may include wicking areas, such that when heat is locally applied to a solder fuse interconnection 94, the solder becomes molten and flows into the wicking areas of the cavities, which breaks the solder fuse interconnection 94 and becomes an open fuse interconnection 96. Thus, where interconnections between the conductive traces 62 and the conductive traces 64 are undesired, the particular solder fuse interconnections 94 may be opened by the technique described above, or by any other technique known to those skilled in the art.

FIG. 13B illustrates a similar embodiment to that of FIG. 13B, but in the embodiment of FIG. 13B the conductive traces 62 are not initially connected to the conductive traces 64 because the conductive material, such as solder, in the cavity does not extend fully between the conductive traces 62, 64, as shown by the open solder interconnections 98. Thus, in the embodiment of FIG. 13B, at each point of connection between conductive traces 62 and 64, a cavity between the conductive traces is partially filled with solder, but the solder does not provide a conductive path between the conductive traces 62, 64. In the locations where interconnections are desired between conductive traces 62, 64, the conductive material, such as solder, may be locally heated to cause the solder to become molten and flow further into the cavity, such that the solder extends between the conductive elements 62 and 64 to create closed solder interconnections 100.

Figure 14:
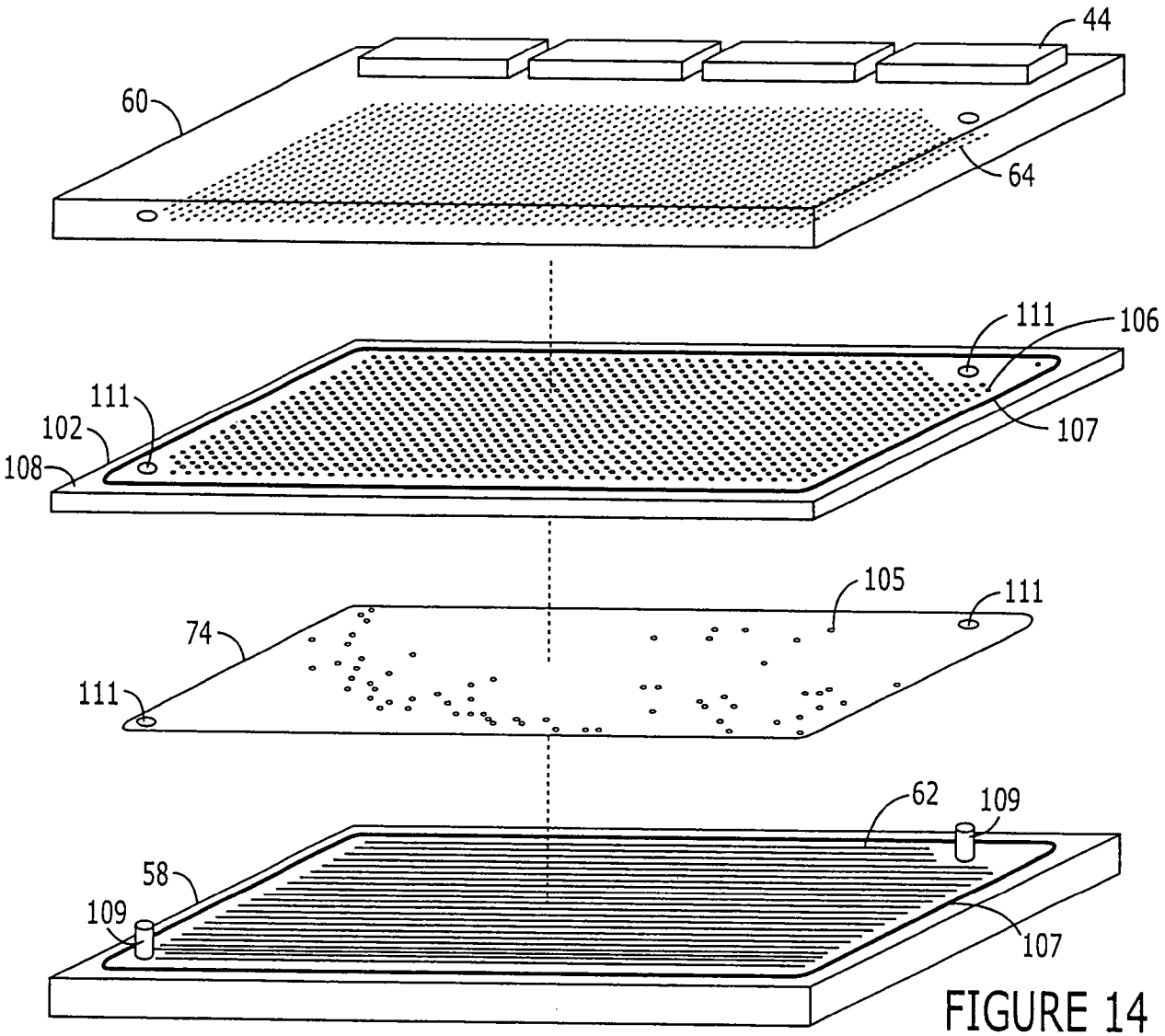
FIG. 14 is an exploded view of an integration area that provides connections between the conductive elements at desired locations utilizing a spring array, according to one embodiment of the present invention.

Another embodiment of a technique for connecting conductive elements 62 and 64 is illustrated in FIG. 14. In this embodiment, conductive element 60 has connectors 44, as described with respect to FIG. 2 above, to attach the integration area to other components. Thus, the connectors 44 include connection elements, such as pins, that connect to at least one conductive trace 64. Conductive element 58 may also include connectors 44 that connect to at least one conductive trace 62. In embodiments in which both the conductive elements include connectors 44, the connectors 44 on one of the conductive elements 58, 60 may provide input signals to the integration area and the other conductive element 58, 60 may provide output signals from the integration area. A spring array 102 and an insulation barrier 74 may be located between conductive elements 58 and 60. The spring array 102 includes multiple spring-loaded conductive pins 106 positioned to extend from one major surface to the other major surface of a layer of non-conductive material 108 such that the conductive pins are capable of connecting various portions of the conductive traces 62, 64. For example, in one embodiment, the number of spring-loaded conductive pins 106 equals the number of conductive traces 62 times the number of conductive traces 64 arranged such that each spring-loaded conductive pin 106 connects one conductive trace 62 to one conductive trace 64.

The insulation barrier 74 therefore defines at least one opening 105 that is aligned with a respective spring-loaded conductive pin 106 that provides a desired connection between a conductive trace 62 and a conductive trace 64. Thus, the only connections between conductive traces 62 and 64 are located where an opening 105 is aligned with a respective spring-loaded conductive pin 106. The insulation barrier 74 may be made of any insulative material known to those skilled in the art, such as Tefzel® ETFE, commercially available from E. I. Du Pont De Nemours and Company Corporation.

Gaskets 107 may be located between the various layers of the embodiment of FIG. 14 to prevent air and/or contaminants from contacting the conductive traces 62, 64 or any other element of the integration area. The gaskets may be made of any type of material capable of providing a seal between the desired layers of the integration area, such as rubber. In addition, at least one guide pin 109 or other locating feature known to those skilled in the art may attach and align conductive element 58, conductive element 60, spring array 102 and insulation barrier 74 as shown in FIG. 14 such as by extending from conductive element 58, through openings 111 in insulation barrier 74 and spring array 102, to conductive element 60.

FIGS. 15A to 15E illustrate various embodiments of the spring-loaded conductive pins 106 that extend through the layer of non-conductive material 108. In all of the embodiments described below, it is assumed that the end of the conductive pin 106 that is opposite the insulation barrier 74 is in contact with a respective conductive trace and when an opening that is aligned with the location of the conductive pin is defined in the insulation barrier 74, the conductive pin connects conductive traces 62 and 64 at the desired location.

Figure 15C:
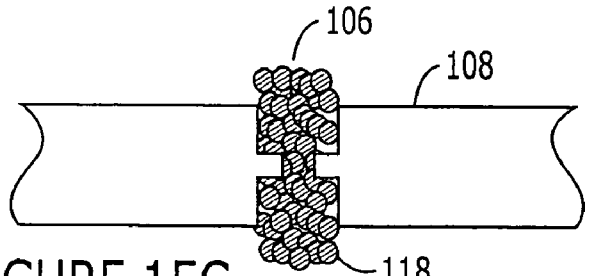
FIGS. 15A-15E are various embodiments of conductive pins that provide connections between conductive elements.
Figure 15D:
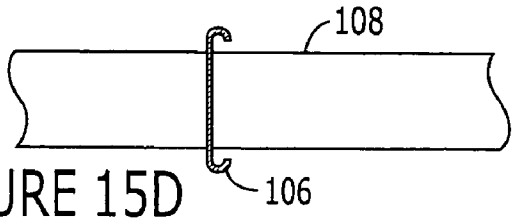
Figure 15E:
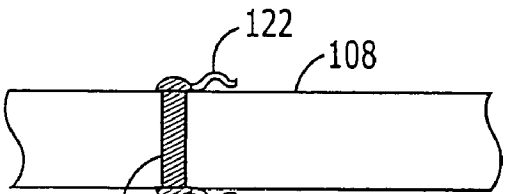
Figure 15A:
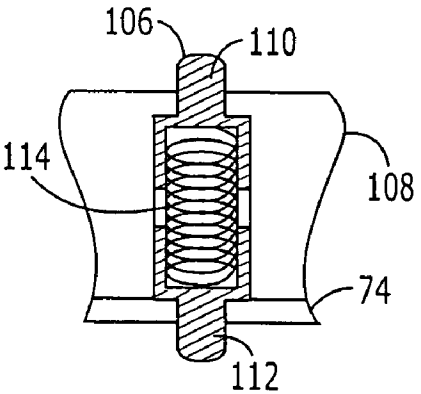

FIG. 15A illustrates one embodiment in which the conductive pin 106 is made of two portions 110 and 112 that each define openings facing one another. A spring 114 with a non-compressed length that is larger than the length of the two openings defined in portions 110 and 112 may be positioned within the openings in portions 110 and 112 such that portions 110 and 112 are slightly separated when the spring is not compressed as shown in FIG. 15A. Thus, when spring 114 is compressed, such as when no opening aligned with conductive pin 106 exists in insulation barrier 74, portions 110 and 112 are closer together than when the spring is not compressed. As such, when an opening that is aligned with conductive pin 106 is defined in insulation barrier 74, as shown in FIG. 15A, the spring 114 is not compressed such that conductive pin 106 extends through the opening in the insulation barrier 74 and connects the desired conductive traces.

Figure 15B:
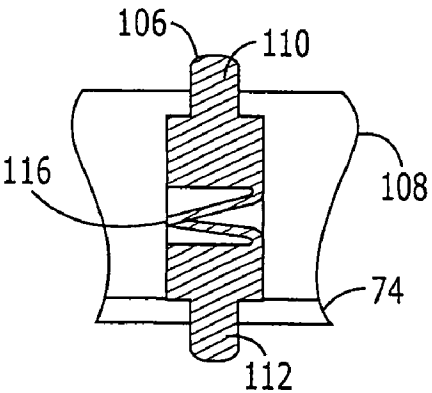

The embodiment of the spring-loaded conductive spring 106 shown in FIG. 15B operates similar to that of the embodiment of FIG. 15A, but instead of being located within openings of portions 110 and 112, the spring 116 is connected to portion 110 at one end and to portion 112 at the other end. Thus, when the spring 116 is compressed, such as when no opening that is aligned with conductive pin 106 exists in insulation barrier 74, the portions 110 and 112 are closer together than when the spring 116 is not compress. As such, when an opening that is aligned with conductive pin 106 is defined in insulation barrier 74, as shown in FIG. 15B, the spring 116 is not compressed such that conductive pin 106 extends through the opening in the insulation barrier 74 and connects the desired conductive traces.

The springs 114 and 116 described in the embodiments of FIGS. 15A and 15B are typically made of a conductive material to ensure conduction through conductive pin 106. The springs 114 and 116 of the embodiments of FIGS. 15A and 15B may be a coil shape or any other shape, size or material known to those skilled in the art that permits a compression when pressure is applied and extension to a resting length when pressure is not applied. For example, the springs 114 and/or 116 may be a conductive Fuzz Button® commercially available from Tecknit.

The embodiment of FIG. 15C, therefore, illustrates that conductive pin 106 may be embodied by a spring 118, such as a conductive Fuzz Button® commercially available from Tecknit, that extends through non-conductive material 108. Thus, spring 118 is in a compressed state when no opening that is aligned with spring 118 exists in insulation barrier 74, but extends to its non-compressed state when an opening is defined in insulation barrier 74 that is aligned with spring 118 such that conductive pin 106 extends through the opening in the insulation barrier 74 and connects the conductive traces 62 and 64 at a desired location.

FIG. 15D illustrates an embodiment of the conductive pin 106 that is embodied in a staple shape. For instance, a substantially straight conductive pin 106 may be inserted through the layer of non-conductive material 108 with a portion of the conductive pin extending from both major surfaces of the layer of non-conductive material 108. The extended portions of the conductive pin may then be bent such that the ends of the conductive pin point substantially toward the respective major surface of the layer of non-conductive material 108. As shown in FIG. 15D, the resulting curved ends of the conductive pin 106 may not be in contact with the layer of non-conductive material when in a resting state. When slight pressure is applied to a curved end, however, the curved end may bend slightly until it contacts the non-conductive material 108, but when the pressure is removed, the curved end may return to its resting state, which is further away from the layer of non-conductive material 108 than the curved end in the compressed state. Thus, conductive pin 106 is in a compressed state when no opening that is aligned with a respective curved end of conductive pin 106 exists in insulation barrier 74, but extends to its non-compressed state when an opening is defined in insulation barrier 74 that is aligned with the curved end of conductive pin 106 such that the curved end extends through the opening in the insulation barrier 74 and connects the conductive traces 62 and 64 at a desired location.

The embodiment of FIG. 15E illustrates a further embodiment of conductive pin 106 that includes a connection via 120 that extends through non-conductive material 108 and connects to spring portions 122 on either side of non-conductive material 108. The spring portions 122 may be connected to the connection via 120 in any manner known to those skilled in the art. For instance, the spring portions 122 may be soldered to the connection via 120. Thus, one of the spring portions 122 is in contact with a respective conductive trace 62, 64 while the other spring portion 122 is compressed by the insulation barrier 74 when no opening aligned with the respective spring portion 122 exists in the insulation barrier 74. As such, when an opening that is aligned with the respective spring portion 122 is defined in insulation barrier 74, the spring portion 122 is not compressed such that conductive pin 106 extends through the opening in the insulation barrier 74 and connects the desired conductive traces.

Figure 16:
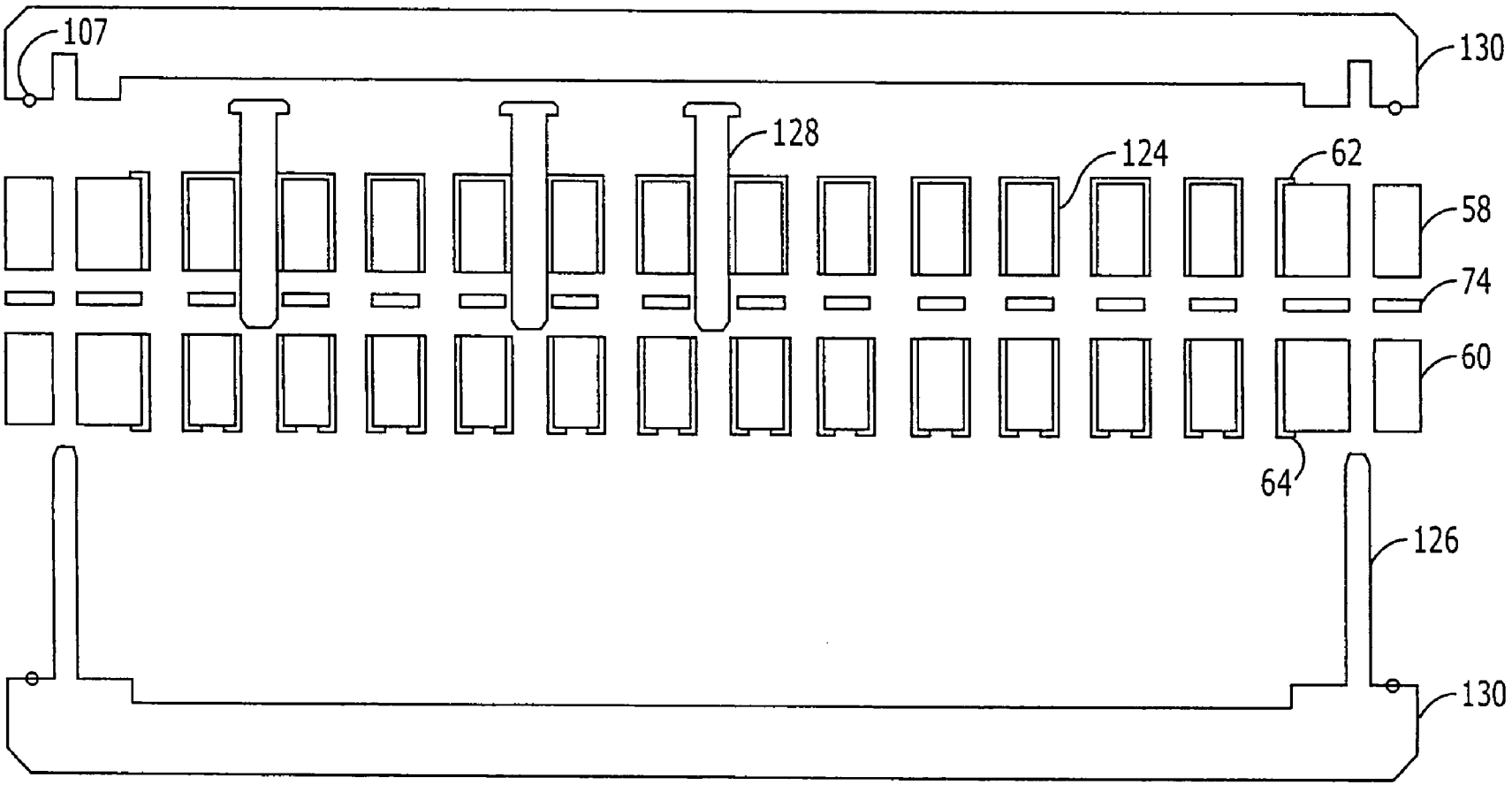
FIG. 16 is a side view of an integration area that provides connections between the conductive elements at desired location utilizing conductive pins, according to one embodiment of the present invention.

FIG. 16 illustrates another embodiment of a technique for connecting conductive elements 62 and 64. In this embodiment, the conductive elements 58 and 60, which may be printed circuit boards, define multiple plated holes 124. Each conductive trace 62 and 64 is connected to the plating of at least one plated hole 124. The plating may be made of any type of conductive material known to those skilled in the art. In addition, the plating may be applied or attached to at least a portion of the inner surface of the holes defined in conductive elements 58 and 60 in any manner known to those skilled in the art, such as by coating at least a portion of the inner surface of the holes with a conductive material.

The conductive elements 58 and 60 may therefore be arranged such that the conductive traces 62 and 64, respectively, are at least substantially perpendicular to one another and the plated holes 124 in one conductive element are at least substantially aligned with the plated holes 124 in the other conductive element. To ensure alignment of the plated holes 124, the conductive elements 58 and 60 may define openings, such as at one or more of the edges of the conductive elements to accept a guide pin 126. Thus, when the guide pin 126 is inserted in the respective openings in the conductive elements 58 and 60, each plated hole 124 in one of the conductive elements aligns with another plated hole 124 in the other conductive element. An insulation barrier 74 may be located between conductive elements 58 and 60 to prevent contact between the plating of the plated holes 124 defined in the conductive elements. Thus, the insulation barrier 74 also defines openings that align with the plated holes 124.

To connect the desired conductive traces 62 and 64, conductive pins 128 may be inserted through the respective aligned plated holes 124 defined in conductive elements 58 and 60, as shown in FIG. 16. The conductive pins 128 may be any shape that securely fits within the plated holes and makes contact with the plating. Examples of certain pins that create a gas-tight connection with the plated holes 124 are described in U.S. Pat. No. 6,231,354 entitled "System for Modifying Printed Wiring Connections After Installation," the contents of which are incorporated herein in their entirety by reference.

At least the outer major surface of the conductive elements 58 and 60 and the conductive pins 128 may be enclosed by covers 130 that may mechanically secure the conductive pins 128 and prevent contaminants from interfering with the conductive elements or any other portion of the integration area. In addition, gaskets 107, as described above with respect to FIG. 14, may be located between the covers 130 and the respective conductive element to further prevent contaminants from interfering with the conductive elements or any other portion of the integration area, if desired.

Many other techniques for providing interconnections between conductive traces 62 and 64 exist and may be utilized in the integration areas of the present invention. For example, in any of the interconnection embodiments described above or others known to those skilled in the art, interconnections may be provided at each point of interconnection and the interconnections may be removed where interconnections are undesirable. For example, the interconnections may be removed as described with respect to the embodiment of FIGS. 12A and 12B, the interconnections may be drilled or burned out of at least one of the conductive elements, and/or the interconnections may be removed in any other manner known to those skilled in the art.

Further embodiments may include the use of programmable logic controllers that make the interconnections between conductive traces 62 and 64, such as by utilizing connection vias between the conductive traces at each connection point and connecting transistors at each connection via which would activate and deactivate the connection via, and thus the interconnection between the conductive traces, as desired. This embodiment could also be accomplished utilizing EPROM technology, as known to those skilled in the art. In these embodiments, an interconnection configuration could be burned into the programmable logic controller or EPROM initially and new configurations could be burned in later, if modification of the interconnections are desired.

In addition, the interconnections may be made utilizing a conductive metal with slightly raised portions for at least one of the conductive traces 62 and 64, where the slightly raised portions are located at the connection points between the conductive traces. The conductive traces may be attached on either side of a board with connection vias or any other type of conductive material located at the points of connection between the conductive traces. Where connections between the conductive traces are desired, pressure and heat may be applied to the slightly raised portions of the conductive traces at the desired locations to deform the conductive traces at that location and connect, such as by soldering, the conductive traces to the connection via at the desired point of connection. In further embodiments, instead of applying heat and pressure to the raised portions of the conductive traces, a latching mechanism may be used to mechanically apply pressure to the raised portions, if desired. Thus, each connection point may include a latching mechanism that may be manipulated to apply pressure to the appropriate portion of a conductive trace.

Thus, the embodiments of the interconnection techniques illustrate that the integration areas may be efficiently created by providing the appropriate connections between the desired conductive traces 62, 64. As such, the integration areas, system of integration areas and method for interconnecting components may be created or performed, respectively, by a machine that receives appropriate configuration instructions defining the locations of the desired interconnections between the conductive traces 62 and 64. Therefore, the integration areas do not have to be manually created like conventional integration areas must be, but instead, may be automatically created by a machine with the appropriate configuration instructions.

In addition, the integration areas and/or conductive paths between integration areas and/or other components may be easily modified after installation because the interconnections in the integration areas and the various conductive paths are easily identified utilizing the techniques of the present invention that clearly show where the existing interconnections are and where other potential interconnections may be located. As such, the integration areas, system of integration areas and methods for interconnecting components are advantageous over the conventional wiring methods and integration areas that are complex and difficult to manipulate after installation.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An integration area providing interconnections, comprising:

a plurality of component connection receptacles;

a plurality of first conductive elements extending from each component connection receptacle;

a plurality of second conductive elements, wherein each second conductive element extends across at least one first conductive element;

a plurality of connections between said first conductive elements and said second conductive elements to provide interconnections, wherein said plurality of connections between said first conductive elements and said second conductive elements comprise at least one conductive pin; and at least one backplane comprising at least third and fourth conductive elements, wherein at least one of the first and second conductive elements is connected to the at least one backplane, wherein said first and second conductive elements each comprise an insulative portion and a plurality of conductive portions.

2. The integration area according to claim 1, wherein said plurality of component connection receptacles comprise a plurality of connector shells and inserts.

3. The integration area according to claim 2, wherein each of said plurality of first conductive elements is connected at one end to an insert.

4. The integration area according to claim 1, wherein said first and second conductive elements define openings at least partially plated with a conductive material, wherein the conductive material of each opening contacts at least one conductive portion of each of said first and second conductive elements, and wherein said at least one conductive pin extends through respective openings in said first and second conductive elements.

5. A system of integration areas providing interconnections among a plurality of components, comprising:

at least two integration areas with each integration area comprising:

a plurality of component connection receptacles;

a plurality of first conductive elements extending from respective component connection receptacles;

a plurality of second conductive elements, wherein each second conductive element extends across at least one first conductive element; and a plurality of connections between said first conductive elements and said second conductive elements to provide interconnections;

a first backplane comprising at least third and fourth conductive elements to provide interconnections;

a second backplane comprising at least fifth and sixth conductive elements to provide interconnections among the plurality of components associated with said first backplane; and a plurality of connection elements between said first and second backplanes, wherein at least one of the plurality of connections between said first conductive elements and said second conductive elements comprise at least one conductive pin, and wherein the conductive elements comprise an insulative portion and a plurality of conductive portions.

6. The system of integration areas according to claim 5, wherein said plurality of connection elements are selected from the group consisting of single wire, coaxial cables, twisted-pair wires and flatwire.

7. The system of integration areas according to claim 5, wherein at least one of the conductive elements is selected from the group consisting of a flatwire segment and a printed circuit board.

8. The system of integration areas according to claim 5, wherein at least one of said first conductive elements and said second conductive elements, and the third, fourth, fifth and sixth conductive elements define openings at least partially plated with a conductive material, wherein the conductive material of each opening contacts at least one conductive portion of the respective conductive element, and wherein said at least one conductive pin extends through respective openings in the respective first and second conductive elements, and the third, fourth, fifth and sixth conductive elements.

* * * * *